United States Patent [19]

Krense et al.

[11] 4,064,416

[45] Dec. 20, 1977

[54] STARTING AND OPERATING DEVICE FOR A HIGH PRESSURE DISCHARGE LAMP

[75] Inventors: Horst Krense, Ottobrunn; Alexander Dobrusskin, Taufkirchen, both of Germany

[73] Assignee: Patent-Treuhand-Gesellschaft fur Elektrische Gluhlampen mbH, Munich, Germany

[21] Appl. No.: 676,448

[22] Filed: Apr. 13, 1976

[30] Foreign Application Priority Data

Apr. 22, 1975 Germany ..... 2517818

[51] Int. Cl.[2] ..... H01J 17/34; H05B 41/19

[52] U.S. Cl. ..... 315/261; 315/60; 315/264; 315/335

[58] Field of Search ..... 315/47, 59, 60, 73, 315/104, 261, 264, 335, 234, DIG. 1, DIG. 5; 313/25, 198, 227

[56] References Cited

U.S. PATENT DOCUMENTS 3,226,597 12/1965 Green ..... 313/198 X 3,445,721 5/1969 Waymouth ..... 315/60

3,619,710 11/1971 Waymouth ..... 315/60 X

*Primary Examiner*—Eugene R. La Roche

*Attorney, Agent, or Firm*—B. R. Studebaker

[57] ABSTRACT

The invention relates to a starting and operating device, including an inductance in the ignition circuit, for a high pressure discharge lamp, especially for a high pressure mercury vapor discharge lamp with metal halide additive, having at least one starting electrode positioned near one of the main electrodes within the discharge vessel. The starting electrode and the main electrode remote from the starting electrode are bridged by an electric circuit externally of the discharge vessel which comprises a current-interrupting and/or current-limiting electrical component. This arrangement of an auxiliary electrode within the discharge vessel of a high pressure discharge lamp brings about a reduction of the supply voltage required for initiation of the discharge which is particularly desirous in the case of high pressure mercury vapor discharge lamps containing metal halides.

16 Claims, 5 Drawing Figures

STARTING AND OPERATING DEVICE FOR A HIGH PRESSURE DISCHARGE LAMP

BACKGROUND OF THE INVENTION

It is common practice to connect the mostly probe-shaped starting electrode with the remote main electrode through a resistance for ignition-current limitation. This may lead to an attack on the seals of both the starting electrode and adjoining main electrode in the discharge vessel to electrolysis. U.S. Pat. No. 2,508,114 accordingly provides a thermal switch in the ignition circuit in series with the starting resistance which interrupts the conductive connection between the starting electrode and the remote main electrode during operation of the lamp. German Pat. No. 1,207,006 on the other hand discloses the elimination of sputtering of the electrode material caused by a continuously flowing current in the ignition circuit. Instead of providing a current-limiting resistance between the starting electrode and the remote main electrode, there is inserted a glow lamp which extinguishes after ignition of the lamp and thus interrupts the conductive connection.

The phenomenon of electrolysis is particularly intense in high pressure mercury vapor discharge lamps comprising a starting electrode and having metal halide additives. German Pat. No. 1,217,496 therefore discloses the insertion of a thermal switch which in normal operation of the lamp provides conductive connection of the starting electrode with the adjoining main electrode. During this, the starting electrode may either remain connected with the remote main electrode through a high-ohmic starting resistance, or it may be disconnected from the main electrode.

In all these known circuit arrangements there exists no conductive connection whatsoever between the starting electrode and its adjoining main electrode during the starting operation. According to U.S. Pat. No. 2,508,114 and German Pat. No. 1,207,006, the connection between the starting electrode and the remote main electrode is interrupted subsequent to ignition of the lamp, i.e. not before operation of the lamp and, consequently, the starting electrode is on free potential. German Pat. No. 1,217,496 on the other hand discloses a device wherein, not before the lamp has ignited, however, the starting electrode is conductively connected to the adjoining main electrode, i.e. these electrodes then have the same potential.

Moreover, it is known (German Pat. No. 1,589,286) to connect a glow switch parallel to the main electrodes of a high pressure discharge lamp having no auxiliary starting electrode, in series with a resistance and a capacitor. Thus, a high sequence of impact-voltage pulses initiated between the main electrodes may already lead to lower ignition voltage peaks and bring about satisfactory ignition.

SUMMARY OF THE INVENTION

It is the aim of the present invention to devise, for a high pressure discharge lamp, especially for a high pressure memory vapor discharge lamp with metal halide additive and provided with an auxiliary starting electrode to facilitate ignition, a starting and operation device which is further improved relative to known circuit arrangements in that substantially reduced supply voltages will initiate reliable ignition, so that an additional conventional starting device may be omitted. The phenomenon of electrolysis, frequently occurring in high pressure discharge lamps with metal halide additives, which otherwise might result in damage to the seals of both the starting electrode and the adjoining main electrode and, consequently, in a destruction of the discharge vessel itself is also eliminated.

The starting and operating device in accordance with this invention includes an inductance in the ignition circuit for a high pressure discharge lamp, especially for a high pressure mercury vapor discharge lamp with metal halide additive and at least one starting electrode positioned near one of the main electrodes within the discharge vessel. The starting electrode and the main electrode remote from the starting electrode are bridged by a first electric bridge circuit externally of the discharge vessel (bridge circuit I) which comprises a current-interrupting and/or current-limiting electrical component and is characterized in that the starting electrode as well as the adjoining main electrode are interconnected by a second electric bridge circuit externally of the discharge vessel (bridge circuit II) which includes a switching element by which said circuit for ignition of the lamp is repeatedly closed and interrupted in alternation and remains closed during operation of the lamp. By means of such a switching element provided in bridge circuit II, there is initiated a sequence of impact-voltage pulses for ignition between the starting electrode and the adjoining main electrode which leads to a rapid pre-ionization of the ignition path; the ignition current then flowing determines preheating of both the starting electrode and the adjoining main electrode. Since these are only spaced a close distance from one another, ignition is already initiated by relatively low ignition-voltage peaks which may be diminished by a factor of 5 relative to conventional ignition circuits. To eliminate the phenomenon of electrolysis, the circuit element is designed such that after ignition of the lamp, i.e. during lamp operation, it remains closed and, consequently, the starting electrode and the adjoining main electrode have the same potential.

A glow switch proved particularly suited as the switching element in bridge circuit II. The glow switch is preferably designed such that its bimetal electrodes are closed when the ambient temperature exceeds 200° C. In addition, the glow switch housing is positioned so close to the discharge vessel of the lamp, within the outer envelope, that subsequent to ignition of the lamp the heat reflected off the discharge vessel causes the bimetal electrodes of the glow switch to remain closed during operation of the lamp and thus the starting electrode is conductively connected with the adjoining main electrode.

Instead of a glow switch there may be employed other suitable switching elements of similar operating charateristic. For example, it is possible to use, in combination with other electrical components, spark gaps, magnetic switches, e.g. reed contacts, or respective electronic switches.

DESCRIPTION OF THE PREFERRED EMBODIMENTS

Figure 1:
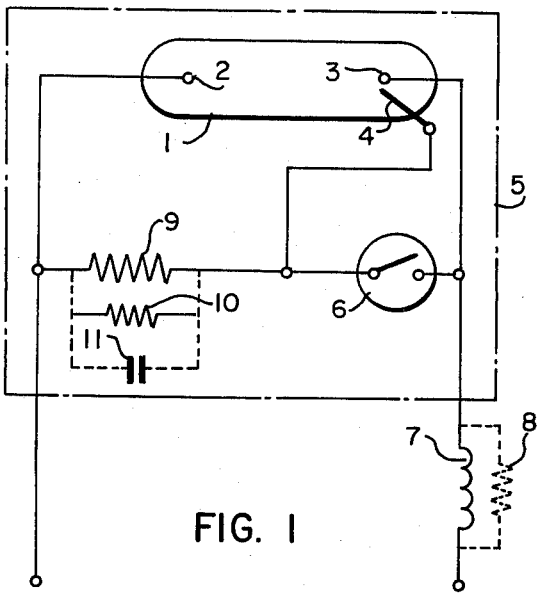
FIGS. 1 through 5 of the accompanying drawings are exemplary embodiments of circuit arrangements for the aforesaid starting and operating device, which all advantageously make use of a glow switch as the switching element in bridge circuit II and show the most suitable combination possible of current-disconnecting and/or current-limiting electrical components in bridge circuit I constituting the device according to the invention, e.g. the glow-switch switching element.

In all the exemplary embodiments of FIGS. 1 through 5 the discharge vessel 1 of a high pressure mercury discharge lamp with metal halide additive is equipped with main electrodes 2 and 3 and a probe-shaped starting electrode 4 arranged close to main electrode 3 within the discharge vessel 1. This discharge vessel 1 is encompassed by a merely schematically illustrated outer envelope 5. A glow switch 6 having the aforesaid characteristics is inserted as the switching element in the second bridge circuit, bridge circuit II, which provides conductive electrical connection between starting electrode 4 and the adjoining main electrode 3, the electric circuit extending externally of discharge vessel 1. A choke 7 in the ignition circuit is preferably used as a series resistance and for the generation of impact-voltage peaks. When using a composite-light lamp, it is permissible to employ its ballasting filament 8 as the series resistance. In this case, the inductance of the power supply is utilized for the generation of impact-voltage pulses or, if the inductance of the power supply is insufficient, an additional inductance has to be incorporated in the ignition circuit.

FIG. 1 shows a circuit arrangement with only one ohmic resistance 9 included in the first bridge circuit, bridge circuit I. The electric circuit connection between starting electrode 4 and remote main electrode 2 extends externally of the discharge vessel 1. The ohmic resistance 9 cannot be disconnected during operation of the lamp and has a resistance value of at least 1000 ohms. Resistance 9 determines the magnitude of current for preheating both the starting electrode 4 and the adjoining main electrode 3, as well as the impact-voltage level between said electrodes. The lower the resistance 9 is, the higher is the preheating current and the ignition voltage, but the greater, too, is the power loss during operation of the lamp when disconnection of the resistance is impossible as in the herein-before mentioned case. It proved suitable to provide an ohmic resistance 9 with a value of 5000 ohms, because the lamps still show sufficient readiness to ignite. This of course depends on the individual lamp types, and a power loss of about 2 watts is still justifiable. When applying a supply voltage of at least 100 volts, current begins to flow after ignition of glow switch 6 through resistance 9 and glow switch 6. In the course of this, impact-voltage pulses are generated through glow switch 6 on starting electrode 4 which, together with the ignition current flowing between starting electrode 4 and the adjacent main electrode 3 to provide sufficient preheating of the electrodes and effect ionization of the ignition path. This leads finally to the ignition of the main discharge path between electrodes 2 and 3. It is likewise possible to incorporate an inductance 10 or capacitance 11 instead of an ohmic resistance 9 and, as already mentioned, choke 7 may be replaced, when using a composite-light lamp, by the ballasting filament 8 of the latter.

Figure 2:
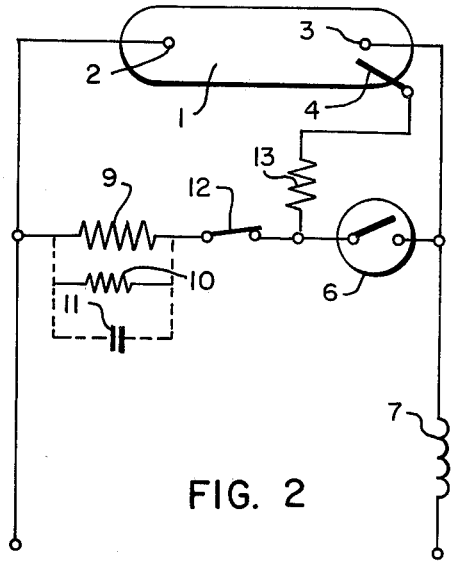

Since for the starting operation itself a low resistance 9 is better suited, but only a relatively high ohmic resistance 9 permits low-loss operation after ignition of the lamp, FIG. 2 provides for instance in addition to an ohmic resistance 9 of from 100 to 1000 ohms, preferably 500 ohms, in bridge circuit I a bimetal switch 12 in series arrangement which is initially closed during ignition. The bimetal switch 12 is designed such as to open at an ambient temperature exceeding 100° C, and to interrupt the bridge circuit I. This is achieved by positioning the bimetal switch 12 relative to the discharge vessel 1 such that after lamp ignition the heat reflected off the discharge vessel 1 effects opening of the bimetal contacts of switch 12. In case of extremely low resistance values of starting resistance 9, provision is made for a protective resistance 13 for the starting electrode 4. This measure is applicable to all the circuit arrangements of FIGS. 1 through 5 and is illustrated in FIG. 5.

Figure 3:
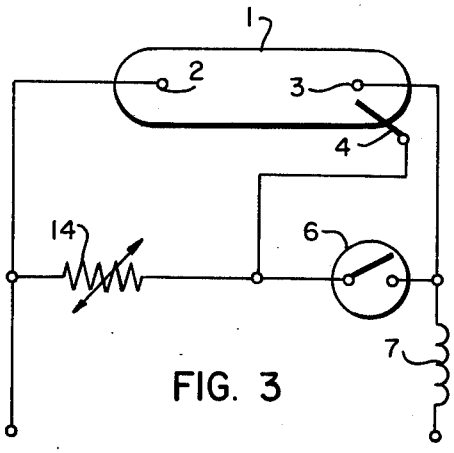

Instead of disconnecting the starting resistance 9 during lamp operation, e.g. by a bimetal switch 12, it is likewise possible to insert a PTC-resistance 14 in the first bridge circuit, bridge circuit I. This arrangement is illustrated in FIG. 3. The PTC-resistance 14 shall be rated for a resistance value of from 100 to 1000 ohms in a cold condition, at an ambient temperature of about 20° C, and at an ambient temperature exceeding 100° C, produced by the operating condition of the lamp, a resistance value of more than 10,000 ohms. Due to this resistance characteristic both the low-resistance values suitable for rapid ignition, and the high-ohmic characteristic of the starting resistance 14 necessary for low-loss operation of the lamp are given. An additional switch may therefore be omitted.

Figure 4:
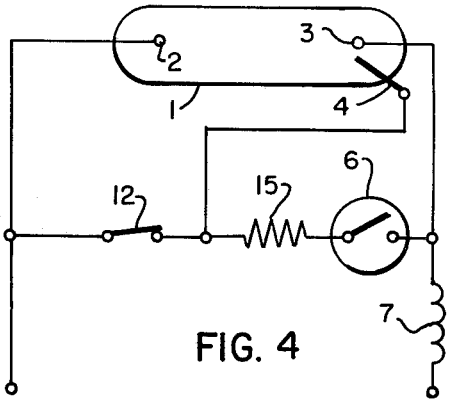

The circuit arrangement of FIG. 4 includes only one bimetal switch 12 in bridge circuit I. Because of this arrangement a higher current is caused to flow through starting probe 4, and preheating of the electrodes 3 and 4 may be substantially intensified. In order to avoid attack on the glow switch 6 by too high a current, an ohmic resistance 15 of about 500 ohms is series connected with glow switch 6 in the second bridge circuit, bridge circuit II. This leads however to a reduced impact voltage because the inductance of the choke cannot become fully effective. The bimetal switch 12 must be rated, of course, for a relatively high current in the order of magnitude of 5 amperes because it has to suffer almost the short-circuiting current of choke 7. It is not possible to completely eliminate the resistance in bridge circuit I without incorporation of a switch, because otherwise only arcing would occur between starting electrode 4 and the main electrode 3, and initial starting of the main discharge path would not be effected.

Figure 5:
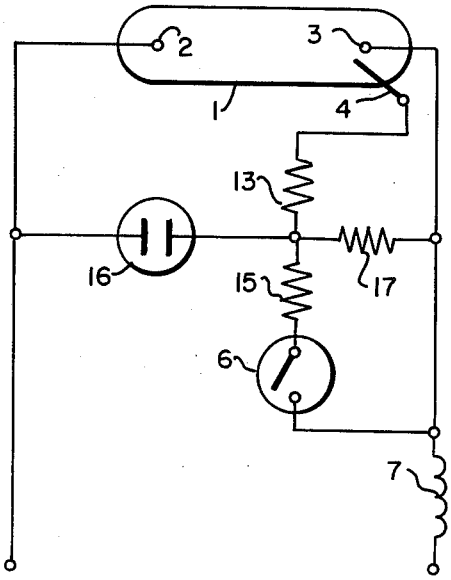

Alternatively, the bimetal switch of bride circuit I may be replaced by a switching spark gap 16 as illustrated in FIG. 5. For this, it is necessary to provide a supplemental high-ohmic starting resistance 17 of about 15,000 ohms in bridge circuit II which is connected in parallel with the series-connected elements, namely resistance 15 and glow switch 6. The starting resistance 17 has to be high-ohmic in order to dampen as little as possible the impact-voltage pulses of the glow switch 6. When the starting resistance 17 is missing, a higher supply voltage would be required for ignition of the switching spark gap 16 and of glow switch 6. While in the circuit arrangements as illustrated in FIGS. 1 through 4 a supply voltage exceeding 100 volts will be sufficient (the starting voltage of glow switch 6 is decisive), it is necessary to apply a supply voltage of at least 180 volts when employing a switching spark gap 16 according to FIG. 5; the starting voltage of switching spark gap 16 amounts to about 180 volts. When applying a supply voltage of, e.g. 200 volts, a current flows after ignition of the switching spark gap 16 at first through the high-ohmic starting resistance 17. The resistance of the switching spark gap 16 is reduced so that sufficient voltage is applied to glow switch 6 for its ignition. After ignition of glow switch 6 the latter starts switching and produces the desired impact-voltage pulses between starting electrode 4 and adjoining main electrode 3. A resistance 15 of about 800 ohms is series connected with glow switch 6 for protection of the latter. After ignition of the lamp, switching spark gap 16 is automatically switched off because the lower operating voltage of the lamp is not sufficient for starting the switching spark gap 16. Glow switch 6 on the other hand is designed such as to remain closed in initially flashed condition of the lamp, so that both the starting electrode 4 and the main electrode 3 have the same potential. In order to protect the starting electrode 4, it is likewise possible to place a protective resistance 13 in front of the starting electrode 4.

It is suitable to arrange the electrical components and switching elements of bridge circuits I and II of said circuit arrangements within outer envelope 5 of the lamp (FIG. 1) which encompasses the discharge vessel 1 and thus to form an integrated unit of lamp and associated starting and operating device. Alternately, it is of course possible to house these elements in a separate replaceable housing.

The circuit arrangements may likewise be used with lamps which are provided with two starting electrodes (one starting electrode in each case near one main electrode). In this case provision has to be made for an analogous circuit arrangement for the second starting electrode.

The same principle applies to all the said circuit arrangements, namely, to generate a plurality of impact-voltage pulses between starting electrode and the adjoining main electrode which are spaced only a close distance from each other, and thus to initiate rapid ignition with as low a supply voltage as possible. This may be achieved most suitably, as shown in the examples, by placing a glow switch between starting electrode and adjoining main electrode. Moreover, measures as to switching techniques have been taken which eliminate the phenomenon of electrolysis in the lamp.

The present starting and operating device is particularly suited for difficulty ignitable high pressure mercury vapor discharge lamps, especially with metal halide additive. An additional conventional starting device (starter or electronic starting device with peak voltages of some kilovolts), as previously required in order to ignite the lamps, can be omitted because already relatively low ignition voltage peaks of some hundred volts bring about satisfactory ignition when using the aforesaid circuit arrangements.

What is claimed is:

1. A starting and operating device in combination with a high pressure discharge lamp of the mercury vapor, metal halide additive type, said discharge lamp including at least one starting electrode positioned near one of the pair of spaced main electrodes within the discharge vessel; said starting and operating device including an ignition circuit having an inductance therein and first and second bridging circuits; said first bridging circuit interconnecting said starting electrode and the main electrode remote from said starting electrode and said second bridging circuit interconnecting said starting electrode and the adjacent main electrode; each of said first and second bridging circuits being external of said discharge vessel and said first bridging circuit comprising a current-limiting electrical component and said second bridging circuit including a switching element whereby said circuit for ignition of the lamp is repeatedly closed and interrupted in alternation during starting and remains closed during operation of the lamp.

2. A starting and operating device for a high pressure discharge lamp according to claim 1, wherein said switching element in said second bridging circuit is a glow switch.

3. A starting and operating device for a high pressure discharge lamp according to claim 2, wherein said glow switch includes bimetal electrodes which are closed when the ambient temperature exceeds 200° C, and said bimetal switch being positioned in close relationship to said discharge vessel of said lamp whereby subsequent to ignition of said lamp the heat reflected from said discharge vessel causes the glow switch to remain closed during operation of said lamp.

4. A starting and operating device for a high pressure discharge lamp according to claim 3, wherein said first bridging circuit includes an ohmic resistance.

5. A starting and operating device for a high pressure discharge lamp according to claim 4, wherein said ohmic resistance value is preferably about 5000 ohms.

6. A starting and operating device for a high pressure discharge lamp according to claim 1, wherein said first bridging circuit includes an ohmic resistance which is connected in series with a bimetal switch.

7. A starting and operating device for a high pressure discharge lamp according to claim 6, wherein said ohmic resistance value is from between about 100 and 1000 ohms.

8. A starting and operating device for a high pressure discharge lamp according to claim 1, wherein said current-limiting electrical component in said first bridging circuit is a PTC-resistor.

9. A starting and operating device for a high pressure discharge lamp according to claim 8, wherein said PTC-resistor has a resistance value of from between about 100 and 1000 ohms at a ambient temperature of about 20° C and a resistance value of more than 10,000 ohms at an ambient temperature exceeding 100° C.

10. A starting and operating device for a high pressure discharge lamp according to claim 1, wherein said current-limiting electrical component in said first bridging circuit includes an inductance.

11. A starting and operating device for a high pressure discharge lamp according to claim 1, wherein said first and second bridging circuits are arranged internally of the light transmissive outer envelope encompassing said discharge vessel.

12. A starting and operating device in combination with a high pressure discharge lamp of the mercury vapor, metal halide additive type, said discharge lamp including at least one starting electrode positioned near one of the pair of spaced main electrodes within the discharge vessel; said starting and operating device including an ignition circuit having an inductance therein and first and second bridging circuits; said first bridging circuit interconnecting said starting electrode and the main electrode remote from said starting electrode and said second bridging circuit interconnecting said starting electrode and the adjacent main electrode; each of said first and second bridging circuits being external of said discharge vessel and said first bridging circuit comprising a current-interrupting electrical component and said second bridging circuit including a switching element whereby said circuit for ignition of the lamp is repeatedly closed and interrupted in alternation during starting and remains closed during operation of the lamp.

13. A starting and operating device for a high pressure discharge lamp according to claim 12, wherein said current-interrupting or current-limiting electrical components in said first bridging circuit are a bimetal switch in series connection with an inductance.

14. A starting and operating device for a high pressure discharge lamp according to claim 12, wherein said current-interrupting electrical component in said first bridging circuit is a bimetal switch and said second bridging circuit includes an ohmic resistance in series with said glow switch.

15. A starting and operating device for a high pressure discharge lamp according to claim 12, wherein said switching element in said second bridging circuit is a glow switch.

16. A starting and operating device for a high pressure discharge lamp according to claim 15, wherein said current-interrupting electrical component in said first bridging circuit includes a switching spark gap and said second bridging circuit includes an ohmic resistance in series with said glow switch, said series connection having a high ohmic starting resistance connected in parallel therewith and another ohmic resistance for protection of the starting electrode between said starting electrode and the interconnection of said first and second bridging circuits.

* * * * *